US006012242A

United States Patent [19]

Atkeson

[11] Patent Number: 6,012,242

[45] Date of Patent: Jan. 11, 2000

[54] PUBLICATION VIEWER

[76] Inventor: George G. Atkeson, 1443 Oaklanding Rd., Mt. Pleasant, S.C. 29464

[21] Appl. No.: 09/034,002

[22] Filed: Mar. 3, 1998

[51] Int. Cl.[7] ..... G09F 11/18

[52] U.S. Cl. ..... 40/471; 40/497; 40/526; 352/99

[58] Field of Search ..... 40/472, 377, 385, 40/393, 524, 525, 526, 527, 528, 497, 499, 500, 512, 471; 352/99, 101

[56] References Cited

U.S. PATENT DOCUMENTS

| | | | |
|---|---|---|---|
| D. 280,517 | 9/1985 | Alsup, Jr. et al. . | |
| 549,309 | 11/1895 | Casler | 40/497 X |
| 571,496 | 11/1896 | Pettenkofer | 352/99 |
| 614,738 | 11/1898 | Marvin | 40/497 |
| 1,767,804 | 6/1930 | MacLachlan | 40/472 |
| 1,774,817 | 9/1930 | Stockton | 352/99 |
| 2,057,719 | 10/1936 | Hartzell | 40/526 |
| 3,619,922 | 11/1971 | Morgan et al. . | |
| 3,783,540 | 1/1974 | Barclay . | |
| 4,182,071 | 1/1980 | Todokoro . | |
| 4,236,334 | 12/1980 | Kimura . | |
| 5,163,240 | 11/1992 | Byers . | |
| 5,367,804 | 11/1994 | Domberg et al. . | |
| 5,477,630 | 12/1995 | Tornow et al. . | |

FOREIGN PATENT DOCUMENTS

| | | | |
|---|---|---|---|
| 1114664 | 4/1956 | France | 40/500 |

*Primary Examiner*—Terry Lee Melius
*Assistant Examiner*—James M Hewitt
*Attorney, Agent, or Firm*—Richard C. Litman

[57] ABSTRACT

A publication viewer for viewing sequential pages of a bound publication, printed on pages attached to a flexible strip of material. The pages include printed text pages and groups of animated pages of drawings or photographs. Indexing notches on the pages are either tagged or untagged so that printed text pages can be viewed for an extended period of time, while the groups of animated pages are viewed in quick succession. The viewer itself is a rectangular box including a rectangular opening with an open view portion for sequentially displaying pages of the publication, and a release button for continuing the advancement of the pages. The back of the box has a rectangular opening through which the publication is loaded into the viewer. A drive mechanism in the form of an AC or DC electrical motor, or a spring wound motor, is operatively connected to a first, bottom shaft. The first, bottom shaft and a second, top shaft are covered by a continuous loop of web material with hooks for engaging the flexible strip of material. As the shafts turn, the hooks in the web pull the drive bar, causing the pages to flip by the viewing window one at a time. An indexing system engages tagged pages so that printed text pages can be viewed long enough to read. The indexing system does not engage untagged pages thereby allowing high-speed sequential viewing of animated pages.

13 Claims, 6 Drawing Sheets

PUBLICATION VIEWER

BACKGROUND OF THE INVENTION

1. Field of the Invention

The present invention relates to a publication viewer. More specifically, the invention is an optical viewer for sequentially displaying characters, texts, and pictures stored on rectangular sheets within an enclosure.

2. Description of the Related Art

Publication viewers have been described in the patent literature. The prior art viewers, however, tend to be complex and bulky, resulting in higher manufacturing costs. Further, thus indexing system of the present invention allows for multi-speed viewing, so that printed text pages are held stationary for reading, while at high speed the viewer produces animation by quickly and sequentially displaying picture or drawing sheets.

U.S. Pat. No. 4,236,334, issued on Dec. 2, 1980 to Kimura, discloses a rotary type information retrieving machine. The machine is designed to bring a plurality of information cards into viewing position by pressing a single key. This viewer has a rather complex control mechanism that is not suited to sequentially displaying the cards either in a slow speed or a high speed mode.

U.S. Pat. No. 5,163,240, issued on Nov. 17, 1992 to Byers, shows a photo display device that stores as well as displays photographs. The device can be manually or motor driven (AC or DC), and displays two photos at a time. Photos are displayed sequentially, but high speed or multiple speeds are not disclosed.

U.S. Pat. No. 5,367,804, issued on Nov. 29, 1994 to Domberg et al., discusses an indicating register that displays magazines. The pages of the magazine include page appendages made of magnetic material for coupling with a magnetic follower. While pages are displayed sequentially, high speed or multiple speeds are not disclosed.

U.S. Pat. No. 5,477,630, issued on Dec. 26, 1995 to Tornow et al., discloses a split flap display device that sequentially displays a plurality of panels. The panels are mounted on a rotor shaft that is easily removed from the display device. Multi-speed viewing is not discussed.

In addition to the above patents, several other patents directed toward publication viewers are known. U.S. Design Pat. No. 280,517, issued on Sep. 10, 1985 to Alsup, Jr. et al. shows an ornamental design for a transparency viewer. U.S. Pat. No. 3,619,922, issued on Nov. 16, 1971 to Morgan et al. discloses a changeable exhibitor that sequentially presents a plurality of printed sheets for viewing. The sheets may be manually or mechanically activated for viewing at the display window. U.S. Pat. No. 3,783,540, issued on Jan. 8, 1974 to Barclay, shows a viewing apparatus that stores and displays a plurality of flat objects at a viewing window. U.S. Pat. No. 4,182,071, issued on Jan. 8, 1980 to Todokoro, discloses a toy television set whereby pictures, characters, and text on a plurality of leaves are displayed in succession through a transparent screen.

None of the above inventions and patents, taken either singularly or in combination, is seen to describe the instant invention as claimed. Thus a publication viewer solving the aforementioned problems is desired.

SUMMARY OF THE INVENTION

The publication viewer of the present invention provides for viewing sequential pages of a bound publication. The publication is printed on a plurality of pages (1,200 to 2,500, on average) that are attached along one of their edges, to a flexible strip of material. A drive bar is connected to the leading edge of the flexible strip of material. The opposite edges of the pages include an indexing notch. Pages immediately following printed text pages that are intended to be viewed for a period of time, include a tag, while groups of pages to be viewed in quick succession, do not have tags. The viewer itself is in the form of a rectangular box with a front, back, top, bottom and two sides. The top of the box includes a rectangular opening with an open view portion for sequentially displaying pages of the publication, and a release button for continuing the advancement of the pages. The back of the box includes a rectangular opening through which the publication is loaded into the viewer.

The viewer also includes a drive mechanism that is either an AC or DC electrical motor, or a spring wound motor. When an electrical motor is used, a power supply and electrical switch are included to provide power to the motor. In the case of a spring wound motor, one end of the drive mechanism extends out of the right hand side of the viewer and is attached to a winding handle, for compressing the spring. Suitable gearing is provided to match the speed of the motor to the desired viewing speed. A first, bottom shaft and a second, top shaft are covered by a continuous loop of web material that results in the shafts spinning in unison. The bottom shaft is operatively connected to the drive mechanism, while the top shaft is driven by the web of material. The web includes hooks for engaging the drive bar on the leading edge of the flexible strip of material. As the shafts turn, the hooks in the web pull the drive bar, causing the pages to flip by the viewing window one at a time.

One of the major advantages of the publication viewer of the present invention is the indexing system. The indexing notch on the outer edges of the pages form an integral part of the indexing system. As previously stated, pages immediately following pages that are intended to be viewed for an extended period of time, include a tag within the indexing notch. When the pages advance, the tags are engaged by a sprocket wheel, thereby holding the tagged page (as well as the publication, the shafts, and the web) in a position wherein the page immediately proceeding the tagged page is displayed in the open view portion. A pawl is provided to hold the sprocket wheel in position. The pawl is attached to a spring-loaded button that extends through the top of the viewer. By depressing the button, the pawl allows the sprocket wheel to rotate one tooth at a time, thus advancing the publication until the tag of the next tagged page engages the sprocket wheel.

In operation, a user loads a publication into the viewer, placing the hooks about the drive bar. If the drive mechanism includes a spring wound motor, the user then winds the spring. In the event that the drive mechanism uses an electrical motor, the on/off switch is placed in the "on" position. The button on top of the viewer is then depressed, releasing the first page. Successive pages are released automatically until a tagged page is engaged by the indexing system. Normally, several pages of text are grouped together, and advancement of the pages is achieved by depressing the button as the user finishes reading the text on each page. In between the groups of text pages, are groups of animation pages that are not tagged. The animation pages flip past at a predetermined speed (preferably 6–20 pages per second), that is determined by the gearing between the drive mechanism and the bottom shaft. It should be noted that for animation, a rate of approximately 14 pages per second is desirable. When the entire publication has been viewed, the publication is removed from the bottom of the viewer.

Accordingly, it is a principal object of the invention to provide a publication viewer wherein successive pages of the publication can be displayed in a high speed, animation producing mode, or in a single page mode for text viewing.

It is another object of the invention to provide a publication viewer wherein the mode of display is predetermined by the construction of the publication.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
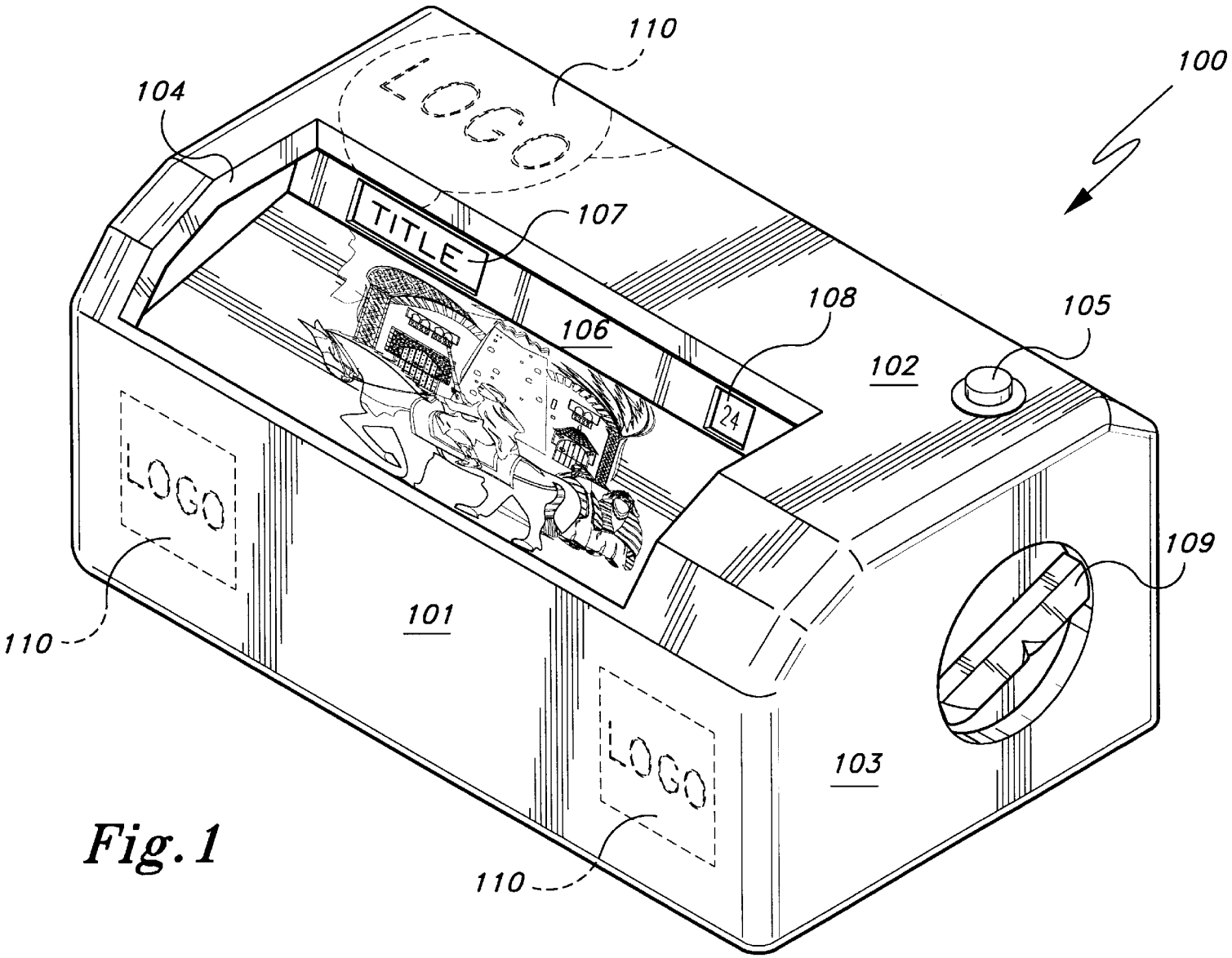
FIG. 1 is a perspective view of the automatic publication viewer of the present invention.
Figure 7:
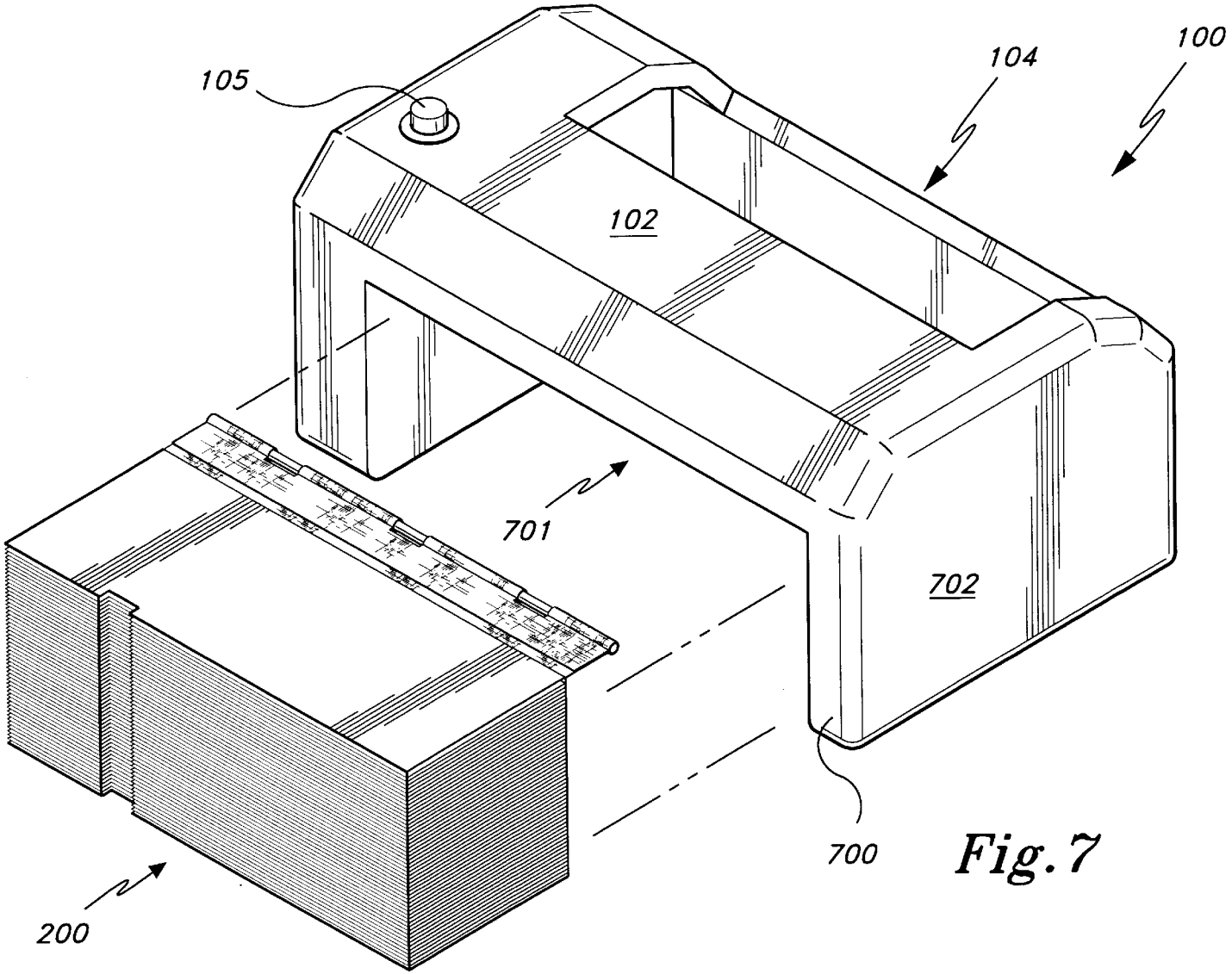
FIG. 7 is an exploded view of a publication being loaded into the back of the viewer.

The present invention is a publication viewer 100 as shown in FIGS. 1 and 7. Viewer 100 is in the form of a rectangular box including: a front 101, back 700, top 102, bottom 701 a right hand side 103 and a left hand side 702. The top 102 includes a rectangular opening 104 with an open view portion for displaying pages of the publication. Within opening 104 is a title bar 106. The title bar 106 includes a title viewing window 107 for displaying the title of the publication, and a frame number viewing window 108 for displaying the sequential number of the frame (or page) of the publication. A release button 105 is provided to advance the pages of the publication. The back 700 includes a rectangular opening through which the publication is loaded into the viewer. The rectangular opening on the back 700 of the viewer 100 extends into the bottom 701 of the viewer 100 to allow removal of the publication after viewing. On the right hand side 103 of the viewer 100, a winding handle 109 is provided to wind the drive mechanism in embodiments having a spring wound motor. The top 102 and front 101 of the viewer 100 are shown with logos 110. Logos 110 may be located on any of the exterior surfaces of the viewer 100, and include but are not limited to: advertisements; name of the viewer; movie or cartoon scenes; etc.

Figure 2:
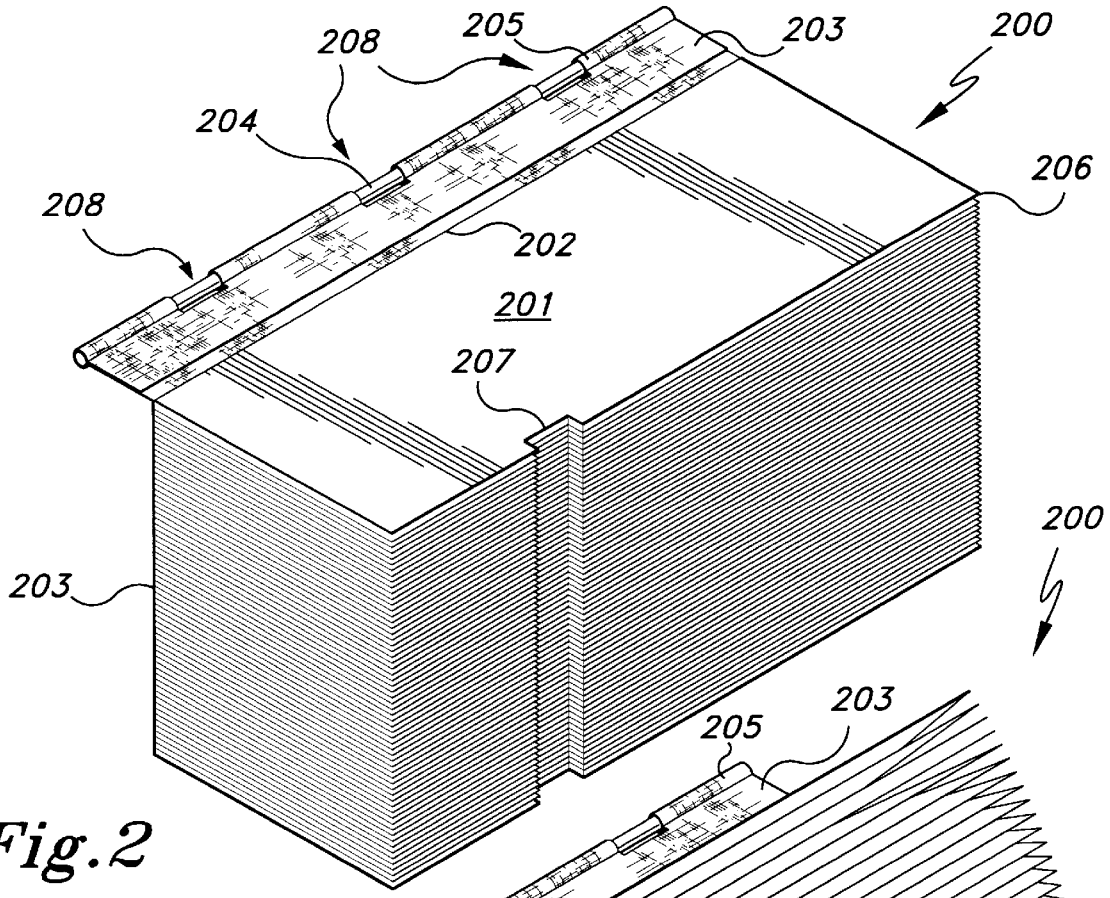
FIG. 2 shows a publication assembled for insertion into the viewer.
Figure 3:
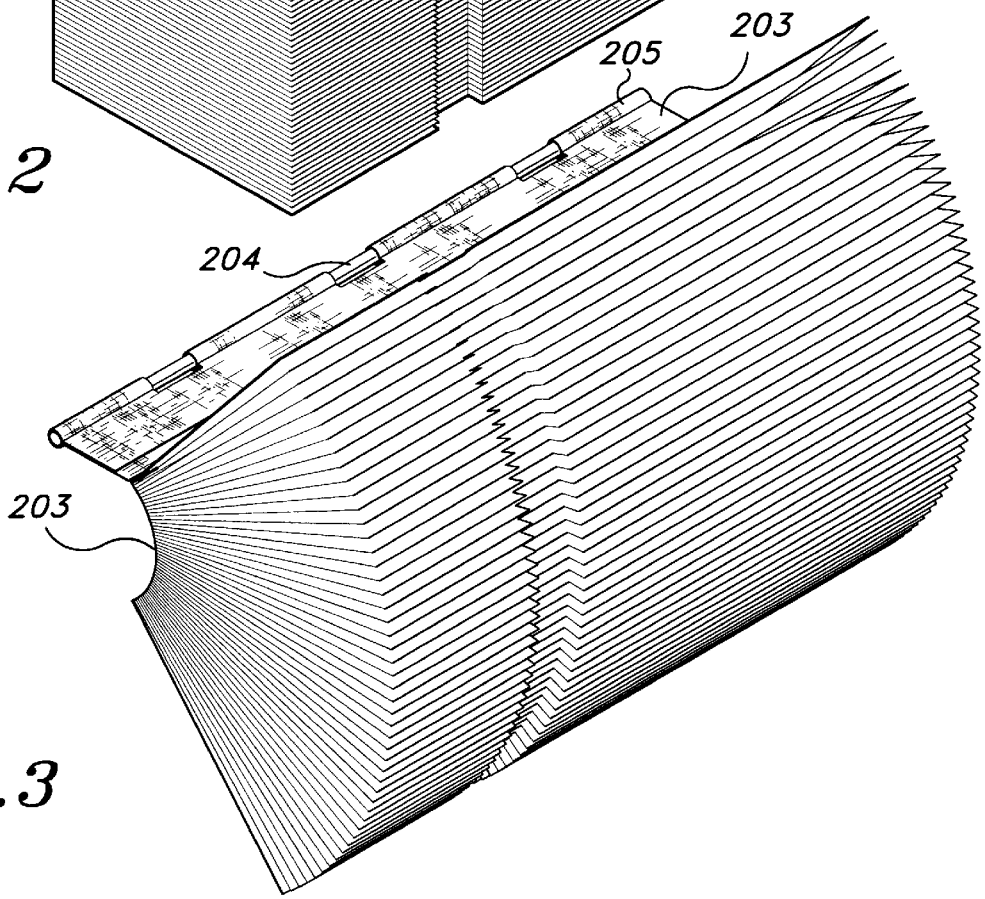
FIG. 3 shows a bound publication in a fanned out condition.

FIGS. 2 and 3 show a bound publication 200 dimensioned and configured to be viewed in the publication viewer 100. The publication 200 is printed on a plurality of pages 201 that are attached along one of their edges 202 to a flexible strip of material 203. A drive bar 204 is connected to the leading edge 205 of the flexible strip of material 203. The flexible strip of material 203 is preferably attached to the drive bar 204 by folding the end of the strip of material 203 over the bar 204 and gluing (or sewing) the material 203 to itself. Slots 208 are provided in the strip of material 203 to allow engagement of the drive bar 204 by hooks as described below. The opposite edges 206 of the pages 201 include an indexing notch 207. Pages immediately following pages that are intended to be viewed for an extended period of time include a tag within the indexing notch 207, while groups of pages to be viewed in quick succession, do not have tags. Note that the tags have been left out of drawings 2 and 3 for clarity, and their function is discussed below.

Figure 4:
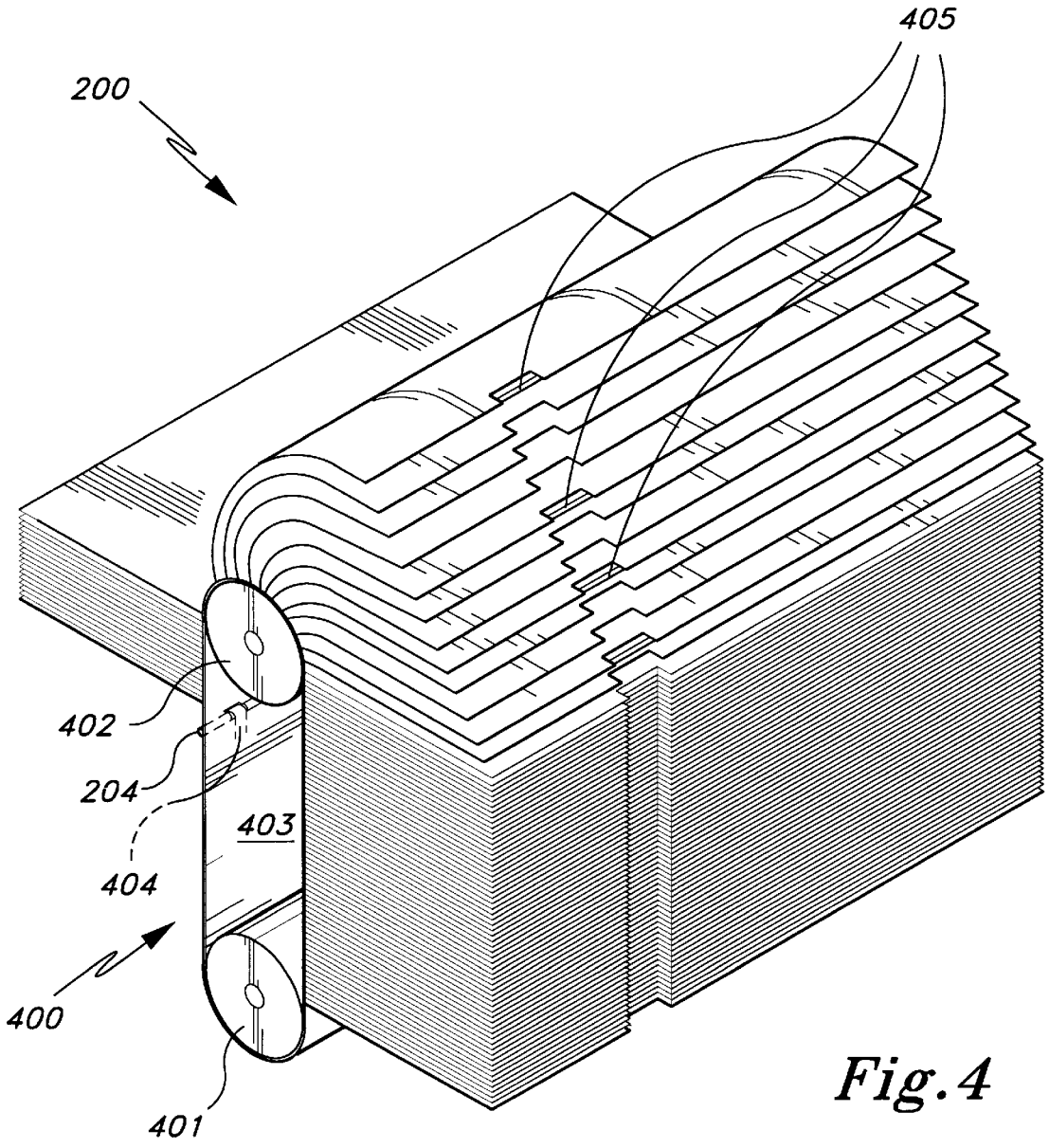
FIG. 4 is an exploded view of a publication being indexed through the viewer.
Figure 6:
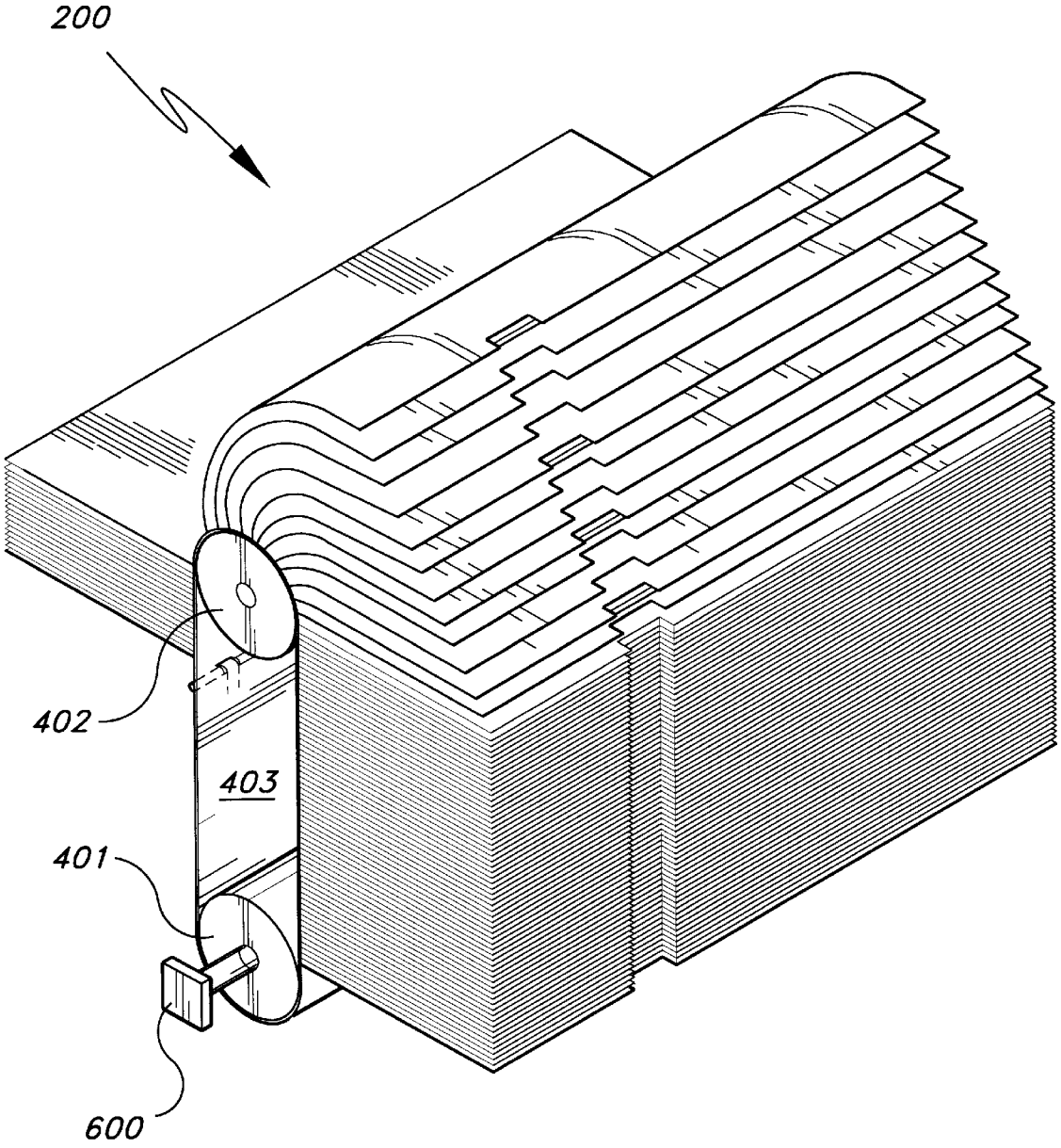
FIG. 6 shows an exploded view of a publication being indexed through the viewer with a motor attached to the bottom shaft.

The viewer 100 includes a drive mechanism shown generally as 400 in FIGS. 4 and 6, (the drive mechanism is shown removed from the viewer to show details). A first, bottom shaft 401 and a second, top shaft 402 are covered by a continuous loop of web material 403. The bottom shaft 401 is operatively connected to a motor 600. The motor 600 is either an AC or DC electrical motor, or a spring wound motor. When an electrical motor is used, a power supply (battery or 110 Volt AC electrical cord and plug) and an electrical switch are included to provide power to the motor. The details of the motor and power supply are well known and further discussion is therefore deemed unnecessary. When a spring wound motor is used one end of the drive mechanism (or an extension of shaft 401) extends out of the right hand side 103 of the viewer 100 and is connected to a winding handle 109. By turning the winding handle 109 in a clockwise direction, the spring-wound motor coils are compressed, thereby storing potential energy as is well known in devices such as clocks, watches, small toys etc. The bottom shaft 401 is thereby urged in the counter-clockwise direction, by the spring-wound motor.

The outer surface of bottom shaft 401 is rough to provide friction between the shaft 401 and the continuous loop of web material 403. In this way, as shaft 401 turns, the continuous loop of web material 403 rotates about shafts 401 and 402. The loop of web material 403 has three hooks 404 for engaging the drive bar 204. It should be noted that while three hooks 404 are preferred, two hooks or a plurality of hooks could be used. The hooks 404 are attached to the loop of web material 403 by either gluing, sewing or both. As the loop of web material 403 rotates about the shafts 401 and 402, hooks 404 pull the drive bar 204 and the strip of material 203 around the top of shaft 402. The indexing system releases the pages (as described below), and the pages flip under the title bar 106 for display in the open view portion 104.

Figure 5:
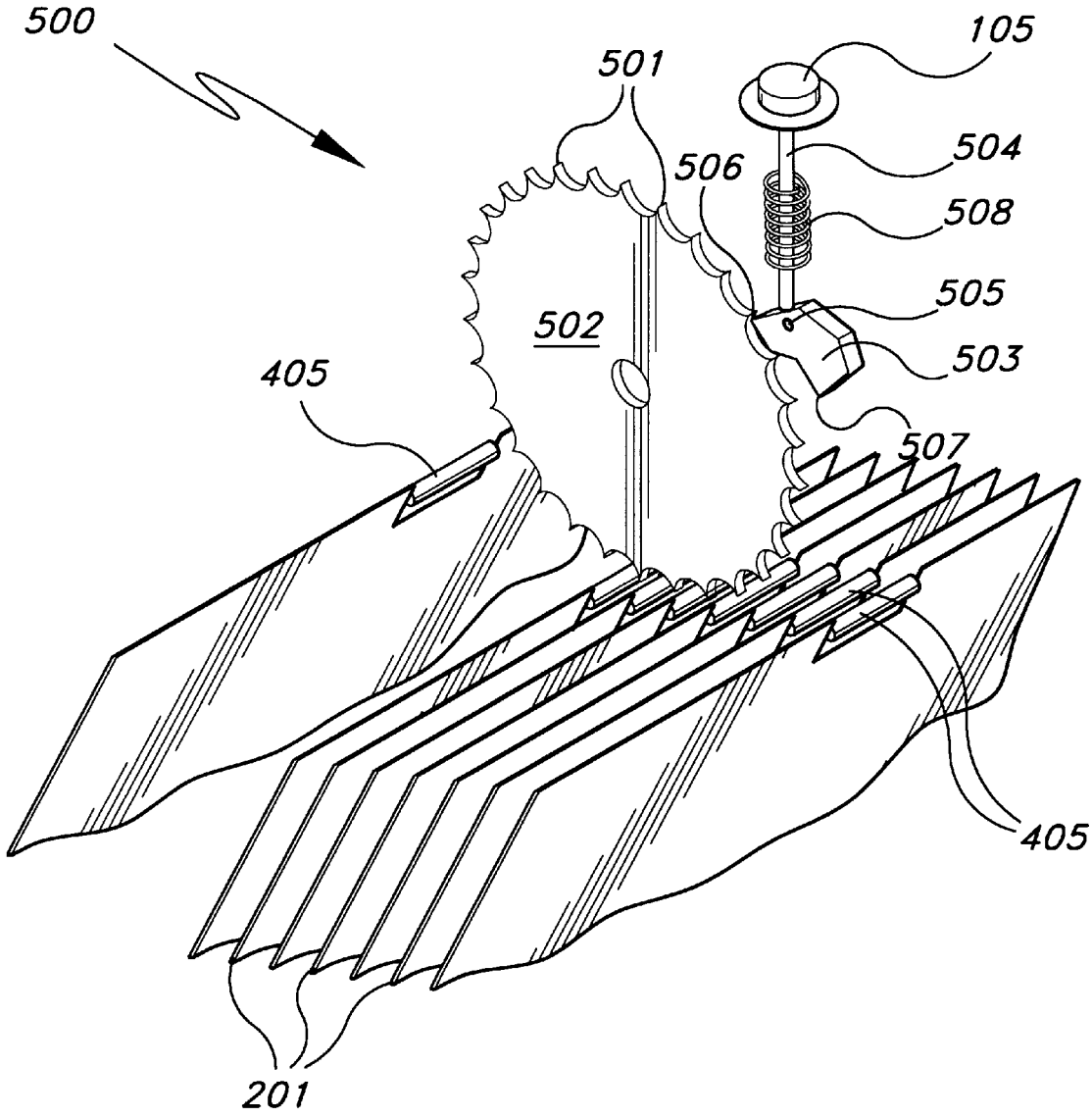
FIG. 5 shows the spring loaded indexing means that feeds the pages of the publication through the viewer.

The indexing system of the publication viewer 100 controls the release of the pages 201 based on tabs 405 in the notches 207 of the pages 201. FIG. 5 shows an exploded view of the components of the indexing system 500. Pages that follow printed text pages that are intended to be viewed for an extended period of time, include tags 405 within their indexing notch 207. When the pages advance, the tags 405 are engaged by the teeth 501 in sprocket wheel 502. The tagged page (as well as the publication, the shafts, and the web) are thereby held in a position wherein the page immediately proceeding the tagged page is displayed in the open view portion 104. The sprocket wheel 502 is rotatable mounted using a suitable bearing and is urged in a clockwise direction by the tags as they engage the teeth 501 of the wheel 502. The leading edge 506 of a pawl 503 inhibits rotation of the sprocket wheel 502.

After a printed text page has been read, (or at the beginning of the publication), a user depresses button 105.

Button 105 is operatively connected to the pawl 503 by a rod 504. When the button 105 is depressed, pawl 503 rotates about pivot 505 and the sprocket wheel 502 is allowed to rotate until the teeth engage the trailing edge 507 of the pawl 503. When the button 105 is released, spring 508 forces the button 105 back up and the tooth contacting the trailing edge 507 of the pawl 503 urges the pawl 503 back to its original position. The leading edge 506 then contacts the next tooth, once again holding the sprocket wheel 502 in place. In this way, each depression of the button 105 results in the sprocket wheel 502 advancing one tooth length. The sprocket wheel 502 is positioned relative to the pages of the publication such that each tab 405 is released when the sprocket wheel 502 is advanced one tooth after the tab contacts a tooth of the wheel 502.

Once a user has purchased the viewer, they would then acquire the desired publications. Because the publications come complete with tagged pages, they are self running, requiring the user to simply depress the button at the beginning of the publication and after reading text pages. By this method, an author can "program" the way their publication is viewed. Publications prepared for viewing may include story books, comic books, magazines, newspapers, etc. These publications are given a new dimension by the present invention, as action sequences can be inexpensively incorporated. These action sequences may include animation (comic or story books), or may be groups of photographs for news reel footage (newspapers and magazines).

It is to be understood that the present invention is not limited to the embodiments described above, but encompasses any and all embodiments within the scope of the following claims.

I claim:

1. A publication viewer for printed material and pictures, said publication viewer comprising:

a publication having sequential pages;

a flexible strip of material having said sequential pages of the publication attached thereto;

driving means for feeding said flexible strip of material through said viewer;

a box having an open view portion for viewing said sequential pages of the publication; and indexing means for presenting said sequential pages in a controlled sequence to said open view portion;

wherein said indexing means includes a rotatable mounted, indexing wheel, said indexing wheel having a plurality of evenly spaced teeth about its periphery; and said teeth engage a portion of said sequential pages of the publication such that pages of printed text are advanced one page of printed text at a time with each page of printed text being viewed for an extended period of time, and such that groups of pages having animated pictures are advanced at a predetermined rate to thereby produce animation.

2. The publication viewer of claim 1, wherein said box is rectangular and comprises:

a front;

a back, said back including a rectangular opening through which the publication is inserted into said viewer; and a top, said top including said open view portion;

a bottom; and two sides.

3. The publication viewer of claim 1, wherein said driving means comprise:

a first and second shaft, one of said first and second shafts having a roughened surface;

a loop of web material extending around said shafts, said loop of web material including engaging means for engaging a leading edge of said flexible strip of material; and a motor attached to said one of said shafts for imparting a turning force to said one of said shafts; wherein said indexing means includes releasing means for allowing said one of said shafts to turn in response to said turning force; and said roughened surface of said one of said shafts engages said loop of web material to thereby cause said loop of web material to rotate about said shafts as said one of said shafts turns, whereby said sequential pages of the publication are sequentially displayed in said open view portion.

4. The publication viewer of claim 3, wherein:

said motor is a spring wound motor including a torsion coil spring operatively connected to said one of said shafts;

said publication viewer further comprises a winding handle attached to an end of said one of said shafts, said winding handle, when turned, causing said coil spring to compress and thereby store potential energy;

said releasing means permitting turning of said shafts and rotating of said loop of web material by said potential energy.

5. The publication viewer of claim 3, wherein:

said motor is an electric motor operatively connected to said one of said shafts; and said releasing means permits turning of said shafts and rotating of said loop of web material by said electric motor.

6. A publication viewer for printed material and pictures, said publication viewer comprising:

a publication having sequential pages;

a flexible strip of material having said sequential pages attached thereto;

driving means for feeding said flexible strip of material through said viewer;

a box having an open view portion for viewing said sequential pages; and indexing means for presenting said sequential pages in a controlled sequence to said open view portion;

wherein each of said sequential pages of the publication has a first edge attached to said flexible strip of material;

each of said sequential pages of the publication has a second edge opposite said first edge;

each second edge includes a notch, each notch being Positioned to cooperate with said indexing means;

said sequential pages include printed text pages and animated picture pages;

said indexing means advances said printed text pages into said open view portion one printed text page at a time with each printed text page being viewed for an extended period of time;

said indexing means advances said animated picture pages into said open view portion in rapid sequence at a predetermined rate, so that an animated sequence is viewed at said open view portion;

at least two of said notches each include a tab;

each of said tabs is engagable by said indexing means;

said indexing means stops the advancing of the sequential pages when one of said tabs is engaged by said indexing means;

said indexing means allowing said sequential pages to advance at said predetermined rate when none of said tabs is engaged by said indexing means.

7. The publication viewer of claim 6, wherein each of said sequential pages of the publication which immediately follows one of said printed text pages includes one of said tabs.

8. The publication viewer of claim 7, wherein:

said indexing means includes a rotatably mounted, indexing wheel, said indexing wheel having a plurality of evenly spaced teeth about its periphery;

said teeth engage said tabs such that said printed text pages are advanced one page at a time with each page of printed text being viewed for an extended period of time, and said animated picture pages are advanced at said predetermined rate to thereby produce animation.

9. The publication viewer of claim 8, said indexing means further comprising:

a pivotally mounted pawl;

a spring-loaded button extending out of said viewer; and a shaft operatively connecting said pawl and said spring-loaded button; wherein said pawl permits said indexing wheel to rotate a single tooth length for each depression of said spring-loaded button.

10. The publication viewer of claim 6 wherein:

at least two of said sequential pages each include a sequential number;

a first separate window in said open view portion is provided to permit viewing of a title of the publication; and a second separate window in said open view portion is provided to permit viewing of the sequential numbers.

11. The publication viewer of claim 1, said indexing means further comprising:

a pivotally mounted pawl;

a spring-loaded button extending out of said viewer; and a shaft operatively connecting said pawl and said spring-loaded button; wherein said pawl means permits said indexing wheel to rotate a single tooth length for each depression of said spring-loaded button.

12. The publication viewer of claim 1, wherein:

said sequential pages include printed text pages and animated picture pages;

said indexing means advances said printed text pages into said open view portion of said viewer one printed text page at a time with each printed text page being viewed for an extended period of time; and said indexing means advances said animated picture pages into said open view portion in rapid sequence at a predetermined rate, so that an animated sequence is viewed at said open view portion.

13. A publication viewer for viewing publications including but not limited to magazines, comic books, and newspapers, the publications including a plurality of sequential, rectangular pages of paper, wherein:

said plurality of rectangular pages of paper including a first group of printed text pages and a second group of sequential, frame by frame drawing or photograph pages, said second group of sequential pages when viewed in rapid sequence producing animation;

said plurality of rectangular pages of paper being bound on a first edge thereof to a flexible strip of material, said flexible strip of material including engaging means on a front edge thereof;

said plurality of rectangular pages of paper including notches on a second edge thereof;

notches on pages that follow said printed text pages further include tabs; and said publication viewer comprises:

a drive means for feeding said flexible strip of material through said viewer, said drive means having an upper shaft and a lower shaft mounted with the upper shaft above the lower shaft, said lower shaft having a coil spring motor for imparting rotational force to said lower shaft;

a hand crank means for rotating said lower shaft to wind the coil spring motor and thereby store potential energy;

a loop of web material looped about said shafts and in frictional engagement with said lower shaft;

connecting means on an outer surface of said loop of web material for engaging the engaging means on said front edge of said flexible sheet of material;

indexing means having a toothed indexing wheel for engaging said tabs on said rectangular pages of paper, and a spring loaded pawl for allowing said indexing wheel to turn one tooth at a time, which in turn allows advancement of one of said tabs at a time.

* * * * *